United States Patent [19]

Buj

[11] Patent Number: 4,979,258

[45] Date of Patent: Dec. 25, 1990

[54] CHILDREN'S FOLDING TOOTHBRUSH

[76] Inventor: Elena M. D. M. D. G. Buj, 105 Carretera General, Hermigua, Gomera, Tenerife, Spain

[21] Appl. No.: 349,751

[22] Filed: May 10, 1989

[30] Foreign Application Priority Data

May 10, 1988 [ES] Spain ..... 8801482

[51] Int. Cl.[5] ..... A46B 9/04

[52] U.S. Cl. ..... 15/167.1; 15/143 R; 15/185

[58] Field of Search ..... 15/185, 184, 172, 144 R, 15/244.2, 143 R, 167.1; D4/104, 107, 108, 124; 403/97, 98, 117, 157, 158, 159

[56] References Cited

U.S. PATENT DOCUMENTS 1,142,356 6/1915 Nellany ..... 15/185
1,956,477 4/1934 Segal ..... 15/185
4,731,896 3/1988 La Tour ..... 15/172 X

FOREIGN PATENT DOCUMENTS 288123 5/1953 Switzerland ..... 15/185

*Primary Examiner*—Philip R. Coe
*Assistant Examiner*—Stephen F. Gerrity
*Attorney, Agent, or Firm*—Collard, Roe & Galgano

[57] ABSTRACT

A children's toothbrush having a handle and an arm joined to the handle and having bristles disposed at one end thereof. A joint is formed on the opposite end of the arm for connection to the handle. The handle has a cavity for receiving the arm and the bristles therein when the toothbrush is folded. There is also a lock disposed in the joint for releasably locking the joint to maintain said toothbrush in an open position. The joint comprises a cylindrical portion formed on the end of the arm having a central pivot hole. An annular channel is formed around the pivot hole and spaced apart wing arms receiving and capturing the cylindrical portion to complete the joint.

2 Claims, 1 Drawing Sheet

CHILDREN'S FOLDING TOOTHBRUSH

BACKGROUND OF THE INVENTION

The present invention relates to a children's folding toothbrush that makes the child fond of dental cleaning, since it offers him a brush which could be considered as a toy.

DESCRIPTION OF THE PRIOR ART

It is obvious that dental cleaning is essential for children. The food products marketed today, under different circumstances, tend to form cavities in young children. It is important to accustom the child, at a very young age, to dental cleaning in order to try to avoid, as much as possible, the formation of cavities.

Many kinds of toothbrushes are marketed to children. In some, the handle is shaped like an arabesque configuration, or an animal, in order to attract the child toward this toothbrush.

BRIEF DESCRIPTION OF THE INVENTION

The children's folding toothbrush proposed by the invention is designed for children's dental cleaning. Due to the peculiar design of this toothbrush, and its attractiveness for the child, the toothbrush will take the shape of any object that could serve as a toy. It may look like, for example, a bizarre animal, an airplane, or any other vehicle. The handle is articulated to the carrier arm containing the corresponding bristles. The articulation of the handle will allow the extension of the bristles carrier arm in relation to the handle to occupy a position of normal use of the toothbrush, or allow the arm, in relation to the handle, to fold up order to keep the bristles hidden in a receptacle. If the toothbrush is an animal, the head could be the receptacle. If it is an airplane, then the back part or cabin is the receptacle. In any case, the purpose of the invention is a toothbrush that folds up or could be extended for its usual use. Its folding allows the bristles to be hidden, and in this way protected, avoiding contamination.

Therefore, the toothbrush offers a functional character in its handle and is attractive for the child, who is interested in folding and unfolding the brush. This helps the child acquire the habit of daily use of the toothbrush and a strong interest, since he will be attracted to the toothbrush handle with the shape of a toy.

The toothbrush also serves as a case, since the bristles and the arm remain inserted into the receptacle in the handle. On the other hand, this case could be fixed to the wall through a self-adhesive tape, or through hanging or suspension from another element to the wall.

Moreover, the toothbrush handle could take the shape of an airplane where the fuselage defines a channel, and the tail or back part defines a spacious receptacle. Therefore, in front of the airplane, parallel wings are provided, and between the wings are joined the bristle carrier arm. Thus, in a folding position, this arm will remain encased in the channel of the fuselage of the airplane, and the bristles will be encased in a bigger cavity in the tail. The joint of the bristle carrier arm to the handle, or to the airplane, will be formed by joining to a pair of spaced apart wing arms formed at the end of the handle. The toothbrush can be locked in its position of use in order to avoid closing. The cylindrical expansion of the end of the joint of the bristle carrier arm incorporates an annular channel that has a pivot that emerges precisely from the inside face of one of the wing arms of the joint. When both elements are turned, the little projection in this channel stops another projection of bigger dimensions. This defines the maximum turning of both bodies or elements. At the same time, disposed between these two projections, is a stop for the arm or brush, in relation to the handle, in order to maintain the brush in its unfolded position during use.

The locking device could be defined as a simple projection that emerges from the end position of the handle and could be finished in a spherical way. It can be placed, in the unfolded position, in a recess in the bristles' carrier arm itself. In this last case, the spherical projection could constitute an element that suspends the toothbrush from any fixed element, using a self-adhesive tape, to a wall or any other support, when the brush is unfolded.

BRIEF DESCRIPTION OF THE DRAWINGS

Other objects and features of the present invention will become apparent from the following detailed description considered in connection with the accompanying drawings, which discloses the embodiment of the invention. In the drawings, wherein similar reference characters denote similar elements throughout the several views.

DETAILED DESCRIPTION OF THE INVENTION

Figure 1:
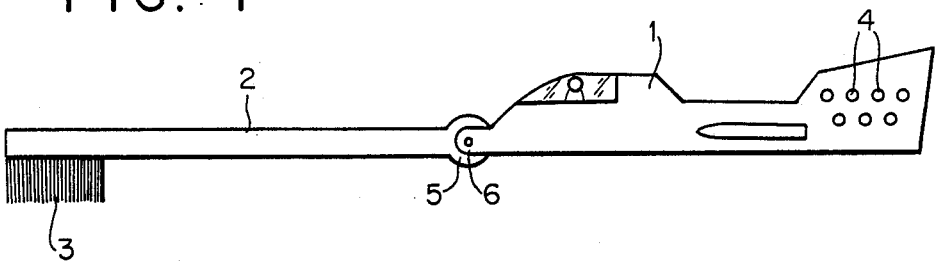
FIG. 1 shows a schematic representation of one of the numerous shapes of the toothbrush configuration, in its unfolded position, ready for use.

Referring to FIGS. 1–5, there is shown the toothbrush of the invention, having a body 1 defining the handle. The handle could assume any configuration, object, or animal.

The invention is shown as a toy for children, such as an airplane, with a channel in its fuselage and a widened cavity in its tail or back part. Body 1 of this airplane is the handle of the toothbrush. Joined to the handle is an arm 2 that carries the bristle 3. The arm 2 and the body or handle 1 could be aligned to form the position of use of the toothbrush. The joint between this handle 1 and bristle arm 2 allows the brush to be folded. The arm remains hidden under the fuselage of the airplane 1, and the bristle 3 are hidden in the wider cavity of the airplane-toothbrush combination. Holes 4 allow air to ventilate the bristles when the brush is folded.

Figure 5:
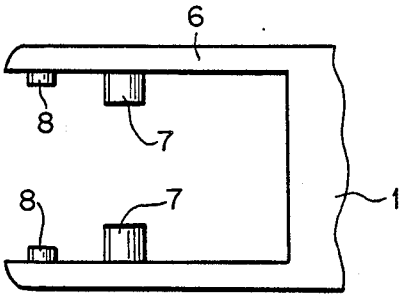
FIG. 5 is an enlarged top view of the end of the toothbrush, having two lateral wings that are placed between the cylindric shape of FIG. 4, thus forming a two piece joint of the toothbrush.

The joint between handle 1 of the toothbrush and carrier arm 2 consists of a cylindrical widening portion 5 formed at the end of arm 2. The cylindrical widening arm 5 is placed between the two lateral wing arms 6 formed at the front portion of handle 1. The arm wings, as shown in FIG. 5, have internal side pivots 7 that will be placed in corresponding holes 8 formed in the cylindrical widening portion 5, corresponding to the end of arm 2. Near the end of wing arms 6 between where it is jointed to the widened part 5 of arm 2, are small clutches 8' that play into an annular channel 9. The channel has in its path, a small projection 10, and near it, a second projection 11 of larger size.

The first and second transverse projections are axially spaced apart by a distance at least equal to the width of said clutches to enable said clutches to be positioned between said projections.

According to the described construction, when the brush is in its unfolded position, as shown in FIG. 1, the clutches 8' will have surpassed the small projection 10, when the arm 2 is turned in relation to handle 1, but the clutches will be stopped by the larger projection 11 in channel 9. Arm 2 can be turned until the top of the clutches meet the larger projection 11. Thereafter, it is not possible to open the brush further, and clutches 8' will remain in the area between the two projections 10 and 11. This prevents the brush from folding up by itself.

Figure 2:
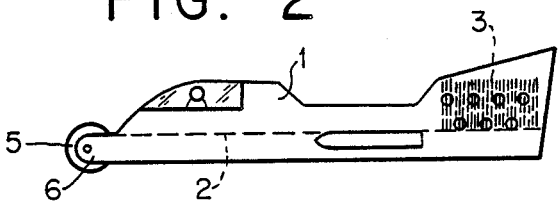
FIG. 2 shows another schematic representation of the same toothbrush in the folded position.
Figure 3:
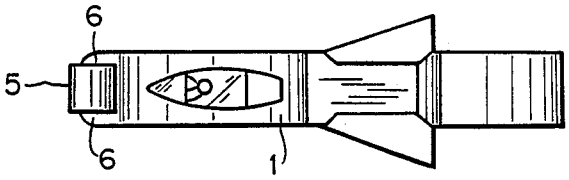
FIG. 3 is a top view of the invention of FIG. 2.
Figure 4:
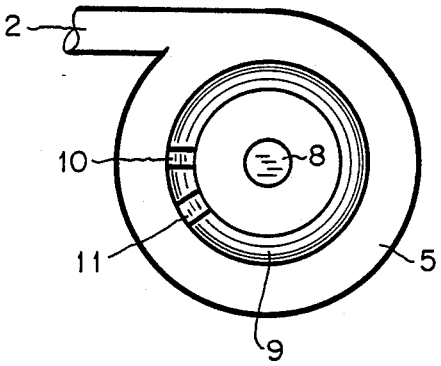
FIG. 4 is an enlarged side view of the end of the bristle carrier arm of the toothbrush, which forms the joint for this carrier arm and of the toothbrush handle, itself.

When the brush is to be folded, as shown in FIG. 2, one may push in the folding direction arm 2 with bristles 3 toward body 1, and the bristles will be hidden inside of handle 1.

The invented children's folding toothbrush is a very attractive element for the child, since it could be considered as a toy, as well as a case for the toothbrush. The bristles remain hidden and protected inside the handle. The child can also play with the toy during its use and can fix it to the wall.

The brush can be made of different materials, and the size of the elements can be varied without essentially changing the invention.

While only a single embodiment of the present invention has been shown and described, it will be obvious that many changes and modifications may be made thereto, without departing from the sphere and scope of the invention.

What is claimed is:

1. A children's toothbrush comprising:

a handle:

an arm joined to said handle and having bristles disposed at one end thereof;

a joint formed on the opposite end of said arm for connection to said handle, said handle having a cavity for receiving said arm and said bristles therein when the toothbrush is in a folded position;

means disposed in said joint for releasably locking said joint to maintain said toothbrush in an open position;

said joint comprising a cylindrical portion formed on the end of said arm, said cylindrical portion having a central pivot hole formed therein and an annular channel formed around said pivot hole;

a pair spaced apart wing arms for receiving and capturing said cylindrical portion;

said cylindrical portion including a first transverse projection formed in said annular channel, and a second transverse projection being of a larger size than said first projection and serving as a stop formed in said annular channel and axially spaced apart from said first transverse projection, and a clutch formed in each of said spaced apart wing arms, so that when the arm and handle are opened, said clutches pass over said first transverse projection in said channel to releasably lock said toothbrush in its open position; and to retain the clutch in the area between the first and second projection.

2. The toothbrush as recited in claim 1, wherein said first and second transverse projections are axially spaced apart by a distance equal to at least the width of said clutches to enable said clutches to be positioned between said projections.

* * * * *